United States Patent [19]

Blaas et al.

[11] 4,434,020

[45] Feb. 28, 1984

[54] METHOD OF MANUFACTURE OF WATERBED LINERS

[75] Inventors: Wolfgang Blaas, Elk Grove Village; Friedrich Bergl, Chicago both of Ill.; Judson D. Wetmore, Huntington Beach, Calif.

[73] Assignee: Hold-A-Fold, Inc., Chicago, Ill.

[21] Appl. No.: 438,177

[22] Filed: Nov. 1, 1982

[51] Int. Cl.[3] ..... B32B 1/02; B32B 1/10

[52] U.S. Cl. ..... 156/216; 4/580; 4/585; 5/451; 52/169.7; 150/49; 156/227; 156/297; 156/475

[58] Field of Search ..... 52/261, 267, 268, 169.7; 5/451, 452; 4/488, 506, 580, 585; 150/49; 156/216, 227, 297, 475

[56] References Cited

U.S. PATENT DOCUMENTS

| | | | |
|---|---|---|---|
| 550,542 | 11/1895 | Smith | 4/580 |
| 2,621,142 | 12/1952 | Wetherell | 156/216 |
| 2,878,488 | 3/1959 | Doskocil | 4/580 |
| 2,950,484 | 8/1960 | Jaffe | 150/49 |
| 3,856,064 | 12/1974 | Swallert | 150/49 |
| 4,393,531 | 7/1983 | Hodel | 5/451 |

*Primary Examiner*—Jerome W. Massie
*Attorney, Agent, or Firm*—Jacques M. Dulin

[57] ABSTRACT

Method of manufacture of seamless, free-standing, self-supporting waterbed safety liners by placing a form onto sheets of liner plastic, folding the corners up adjacent the side walls of the form into hospital corners, lapping excess plastic into the form, applying glue to selected areas of risers, placing strips of rigid riser material against the corners, reverse lapping the excess plastic to secure it to the glue areas on the risers, and removing the form. Methods of folding the completed liner and installation are disclosed.

5 Claims, 11 Drawing Figures

METHOD OF MANUFACTURE OF WATERBED LINERS

RELATED CASE

The waterbed liner itself and an alternate method of manufacture are disclosed in our copending application Ser. No. 384,343 filed June 2, 1982, entitled Seamless, Self-Supporting Waterbed Liner Unit and Method of Manufacture, the disclosure of which is incorporated by reference herein.

FIELD

The invention relates to a method of manufacture of seamless, self-supporting waterbed liners.

BACKGROUND

Waterbeds today comprise a heavy vinyl mattress, usually of 20-gauge plastic, which is placed in a sturdy wood frame platform supporting a bed box comprising a continuous bottom of planks or plywood sheet and a substantial side rail perimeter frame. In the event the mattress is punctured, the water in the mattress could leak, damaging the bed frame, the floor, and other items wherever the water ran. Accordingly, a plastic safety liner sheet is usually disposed between the mattress and the frame sides and bottom before the mattress is installed and filled. This sheet is usually 8 mil vinyl plastic, and serves to contain any water which leaks from the mattress.

There are a variety of methods of manufacture and installation of waterbed safety liners in current usage. First, regarding manufacture, a principal method involves welding the corners of the liner to form a box corner. An appropriately sized sheet of plastic is folded diagonally to form a triangle, and an induction welding machine is used to form a weld line along the two folded corners parallel to the two sides (not the hypotenuse) of the triangle, and the small triangular scraps are cut off and discarded as waste. The sheet is then folded diagonally the other way and induction welded to form the other two corners.

Second, as to installation, this corner-welded box liner is then shipped to the customer's installation site where a variety of installation methods are employed. Usually, the vertical sides of the safety liner are higher than the frame side. In one installation, the excess height is cut off, or folded over, below the side frame top edge, and taped in place. Alternately, the box liner may be stapled in place along its upper edge. Or, strips of wood may be nailed over the upper edge of the liner. Still another method involves cutting strips of cardboard from packing boxes, placing them adjacent the frame sides, tucking excess liner material over the top of the cardboard and between it and the frame sides, then securing it to the frame sides (by taping, tacking, or stapling through the liner and cardboard). In some instances such securing means are omitted, but keeping the liner in place while installing and filling the mattress is tricky.

Recently, the "Tuckaliner" (U.S. Pat. No. 3,973,282) has become employed as an installation device and method. The "Tuckaliner" is a strip of resilient material, e.g., a plastic, having a first rolled longitudinal edge, a second longitudinal flat edge, and a bowed portion therebetween. The strips of the "Tuckaliner" are cut in the field to the bed length and width, and installed by nailing or stapling it midway up the frame sides with the rolled edge at the upper edge desired for the top of the safety liner. The welded box corner liner is then fitted into the bed frame, and the excess of the side risers are tucked in behind the rolled edge of the "Tuckaliner." The bow portion keeps the liner in place against the frame side by its spring action.

All these taping, tacking, stapling or cut cardboard field installations are time consuming, labor intensive, and therefore expensive. Further, where stapling or tacking is used, the liner is punctured below its upper edge, permitting some leakage possibilities.

A less field-labor intensive liner unit is the "Delta Star" type (made by Del Astra Industries, Stockton, CA). This is a welded, fitted liner that has rigid supporting strips self-contained in double side walls of plastic sheeting. The plastic sheeting completely surrounds the supporting strips, and the sheeting is then welded at the exterior bottom edge all around the periphery. Four or eight support strips are used, one or two along each side and the ends, and they are not joined at the corners. While this system is fast to install in the field, it is expensive to make as it requires more plastic sheeting, use of expensive welding equipment, and more factory labor.

Another field installation method involves making a hospital corner in the liner plastic at each corner of the bed frame followed by taping or stapling it to the bed frame. The hospital corner is a method of field forming a relatively neat corner as compared to a manufactured, induction-welded box corner. This corner forming and securing is field-labor intensive and expensive. Field labor is usually more expensive than factory labor.

Accordingly, there is a need for a waterbed liner unit that can be easily made in the factory to precise dimensions, and which does not involve use of expensive induction welding equipment, yet which unit has free-standing, self-supporting side walls for easy and quick field installation, without the disadvantages of time and materials expense of employing securing means.

THE INVENTION

Objects

It is among the objects of this invention to provide a method of manufacture of seamless, free-standing, self-supporting weaterbed liner units that can be easily folded into a convenient shipping size and which method is simple and not labor intensive.

Another object is to provide a method of manufacture of a self-supporting waterbed liner unit which does not employ expensive plastic welding equipment.

Still further and other objects of the invention will be evident from the detailed description which follows.

THE DRAWINGS

The detailed description will be in reference to the drawings in which.

SUMMARY OF THE INVENTION

A seamless, self-supporting, free-standing waterbed safety liner is formed by the method of the invention into a prepackaged unit by steps of laying out flat sheets of liner plastic onto a support, typically a folding table, and positioning a folding form centrally thereon. The sides of the sheet plastic are then folded vertically upward adjacent the side walls of the form with a Z-fold hospital corner formed at the four corners. The edtes of the sheet extend upwardly beyond the upper edges of the form, and this excess is lapped (let lie) inwardly (centrally) into the form. Then glue is applied to one side of a rigid strip of riser material along one longitudinal margin. The riser is scored (or two pieces are taped) to be bendable medially of its ends to form a right angle corner. The unglued side of the riser is then placed against the upstanding plastic and bent 90° around a corner of the form. The excess plastic, heretofore lapped into the form, is then folded back over the outer, glued face of the riser, with the tip of the hospital corner now lying on the outside of the riser, several inches below the upper marginal edge of the riser. All four corners are done in the same manner to form the finished liner unit. The form is then raised out of the finished liner unit, leaving it in freestanding form ready for folding for shipping.

The unit is folded by bringing the side gaps between adjacent corner risers together along the center of the sides, and folding the pairs of corners together. The floor area of the liner is then wrapped tightly around the risers, and bagged for shipping.

Field installation is "instant" in that the liner is simply taken from the bag, unrolled, unfolded, and the sides straightened. The liner is in position to receive the mattress bag.

The liner unit is seamless, thus avoiding the need for expensive, high-frequency induction welding machines. The liner unit is easy to install in the field as it is free-standing and self-supporting, resulting in negligible field set-up costs. The method of manufacture to form the corners and secure the riser thereto is simple and non-labor intensive, thus reducing labor costs.

DETAILED DESCRIPTION OF THE PREFERRED EMBODIMENTS

This detailed description has reference to the accompanying figures which are illustrative and not limiting of the principles of the invention.

Figure 1:
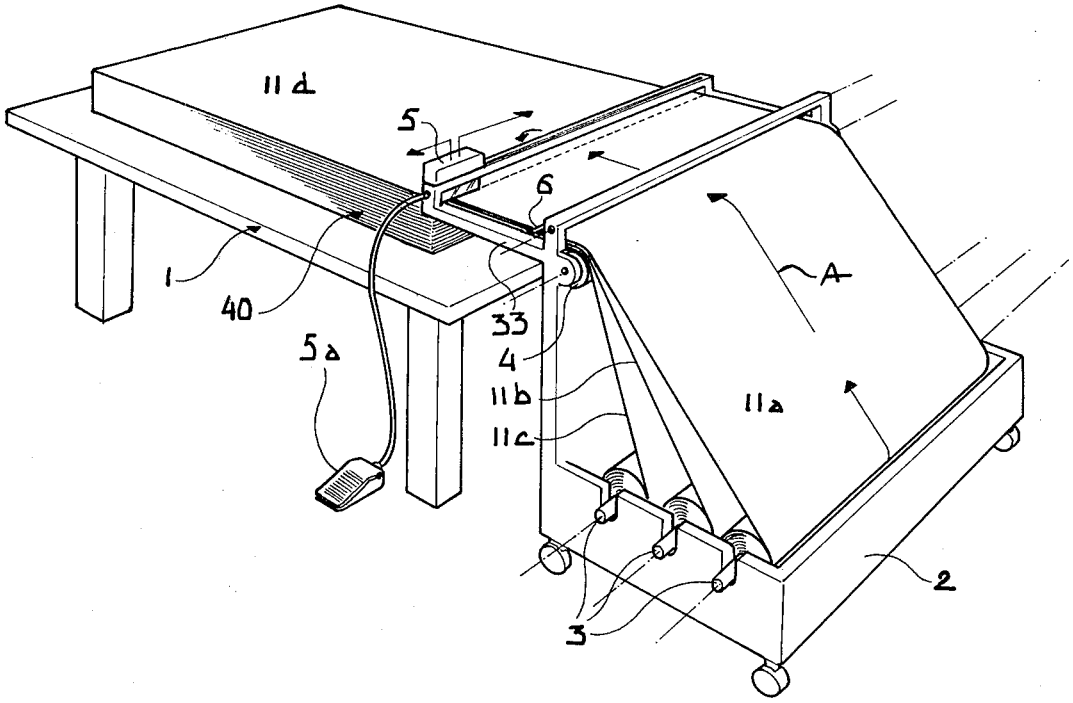
FIG. 1 is a perspective of an assembly table involved in the steps of manufacture of free-standing waterbed liners in accord with the invention.

FIG. 1 shows in perspective a work table 1 for supporting a stack of plastic sheets 40 thereon, and associated means for supplying the plastic sheets thereto. The plastic sheet feed means includes a dolly 2 which retains a plurality of rolls of vinyl plastic 11*a*, 11*b* and 11*c* therein. The sheets of plastic are fed upwardly as seen by the arrow A over a roller 4 and across feed lip 33. In the example shown, three rolls of plastic provide the three sheets 11*a*, 11*b* and 11*c* which are drawn out and positioned onto the top of the table 1. After they are positioned, an electric cutter assembly 5, which is activated by the foot pedal 5*a*, cuts all three sheets simultaneously to appropriate size. The doctor blade 6 keeps the three plastic sheets from wrinkling and removes air bubbles as the sheets are drawn across the lip. In addition, it prevents the plastic sheets from falling back after they have been cut by cutter 5. Typically, the plastic is 8 mil vinyl sheet, although it may be heavier or lighter.

Figure 2:
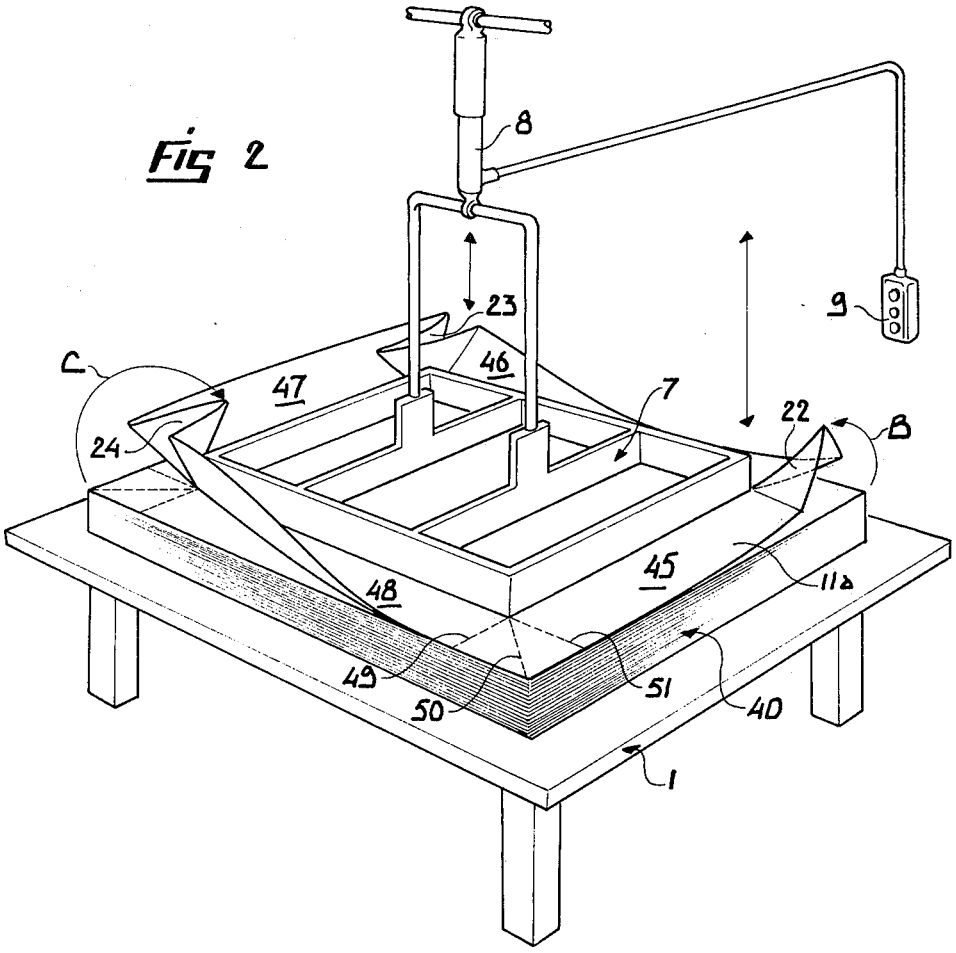
FIG. 2 is a perspective showing the folding form in its lowered position and illustrates corners being initiated with z-folds in the plastic sheeting.
Figure 3:
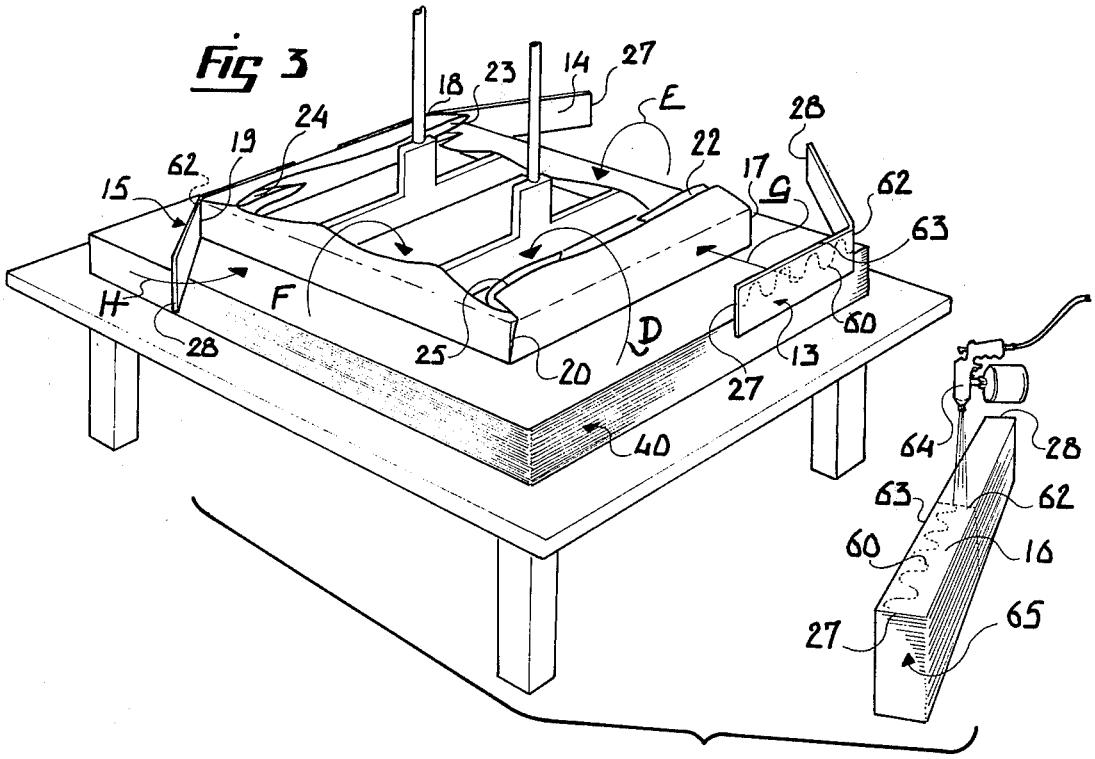
FIG. 3 is a perspective showing the folded plastic corners folded into the form and the risers being glued and applied.
Figure 4:
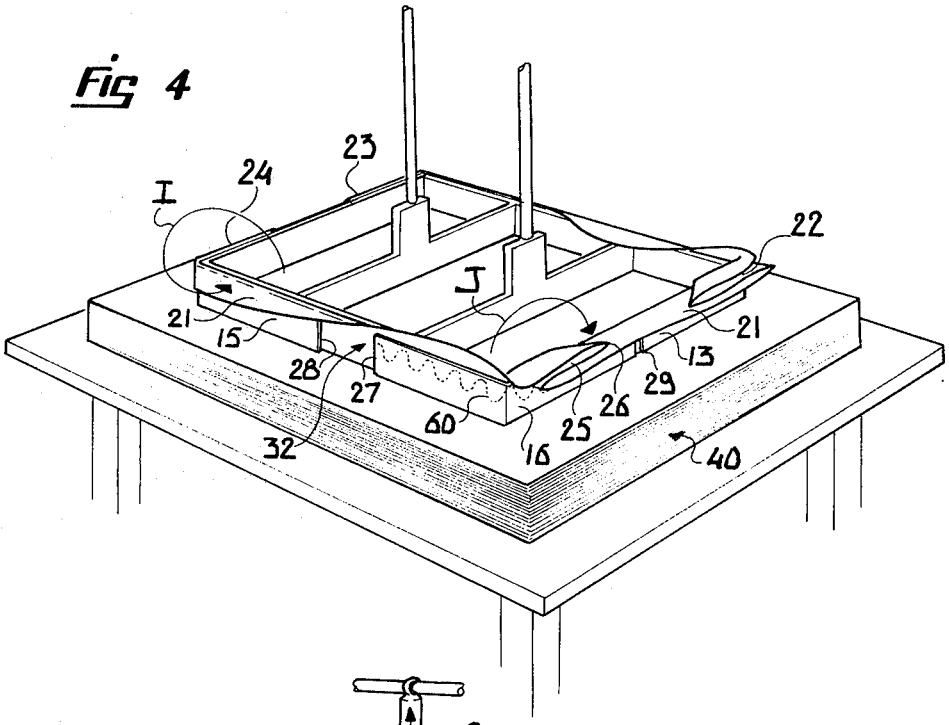
FIG. 4 is a perspective showing the reverse folding of the skirts of the plastic over the risers.

Referring now to FIG. 2, in this figure the sheet feed assembly is not shown for simplicity. After the cutting and stacking of the sheets of plastic 11 which form the waterbed liner, a form 7 is lowered down onto and in contact with the topmost sheet by a reciprocating lift assembly 8 which is actuated by lift control 9. As shown in FIGS. 2, 3 and 4, the perimeter area 45, 46, 47 and 48 of the vinyl sheet which extends beyond the edges of the form are folded up to form the corners of the waterbed liner. Three fold lines 49, 50 and 51 may be marked on the plastic sheet, but are not necessary. The line 49 is an extension of the short end of the form, while line 51 is an extension of the long side of the form. Line 50 is the diagonal line. Since these are easy to see, no marking is necessary, but may be put on the plastic if desired. As seen by arrows B and C in FIG. 2, a corner is formed by folding the diagonal line 50 across one or the other of the other fold lines 49 or 51. In that way a reverse hospital fold 22, 23, 24 and 25 is formed. These can also be seen in FIGS. 3 and 4.

As best seen in FIG. 3, the perimeter areas of the plastic sheet extend upwardly beyond the edges of the form 7 and are lapped inside the form as seen by arrows D, E and F. Then individual risers 13, 14, 15 and 16 (FIG. 4) are applied to the corners 17, 18, 19 and 20 of the plastic liner. The risers comprise a rigid material, for example, 200-lb test corrugated cardboard in the form of strips which are folded medially of their ends 27, 28 at score line 62. As seen in FIG. 3, glue 60 is applied by a spray gun 64 adjacent the topmost edge 63 of the riser 16. As seen by arrow G, a riser 13 is placed with its glued face outwardly against the form with approximately half of it extending out beyond the edge of the form. A portion of the riser which then extends out beyond the form is then folded into contact with the other face of the form as seen by arrow H in FIG. 3.

As best seen in FIG. 4, the adjacent risers, after being placed and bent around the corners, have a gap 29, 30, 31 or 32 between their adjacent ends 27 and 28. This permits folding of the liner assembly after forming. Also as seen in FIG. 4, the excess plastic which had been laid into the form is now reverse folded as shown by arrows I and J back over onto the glued surface of the risers, and the glue secures the plastic thereto. This completes the forming of the hospital folds 22, 23, 24 and 25 with the tip of the fold 26 lying now on the exterior of the waterbed liner unit.

Figure 5:
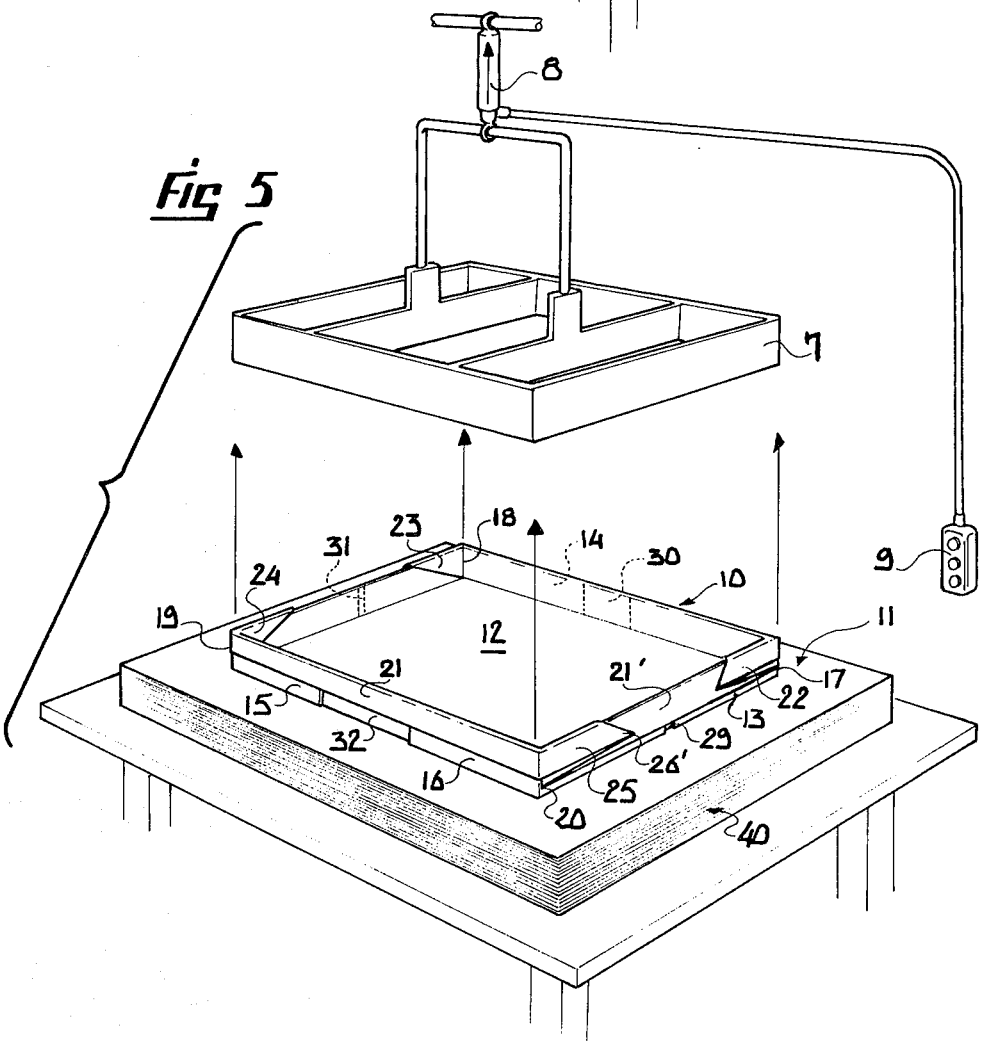
FIG. 5 is a perspective showing the lifting of the form to its upper position and the completed liner.

As best seen in FIG. 5, the form 7 is then raised by the reciprocating lift 8 leaving the completed free-standing waterbed liner unit 10 having a central area 12 and the upstanding sidewalls formed by the risers 13–16 and the overlapped corners 17–20. It can be seen by viewing the corner 23 in FIG. 5 that any water which leaks out from the waterbed mattress is contained in the space defined by the floor area 12 and would not be able to leak outside as the corner is folded up and over the respective risers, and the tip 26 of the corner is then trapped between the exterior of the waterbed liner and the inside of the waterbed frame (not shown). The corner fold can be reversed, that is, the fold tucked behind the plastic sheeting along the riser wall. We prefer to have the end overlap 21′ as seen in FIG. 5 longer than the sidewall overlap 21 so that the tip 26' is secured by the glue to the riser material.

Figure 6A:
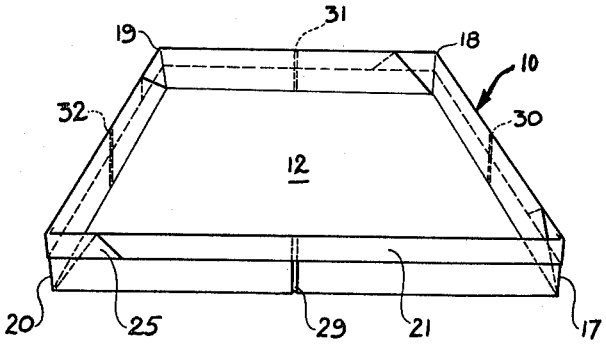
FIGS. 6*a–f* illustrate, in sequence from a–f, the method of folding the manufactured liner for shipping, and considering the sequence in reverse from f–a, the field method for set-up of the liner in the bed frame.
Figure 6B:
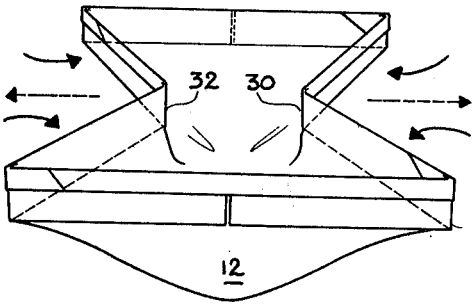
Figure 6C:
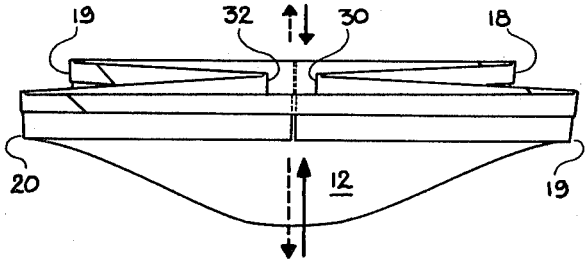
Figure 6D:
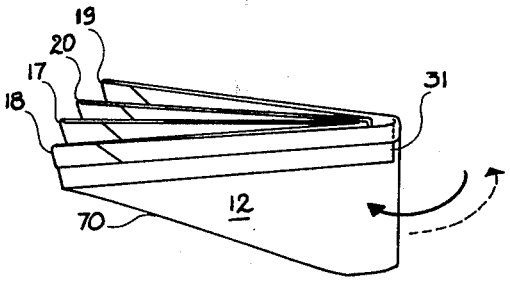
Figure 6E:
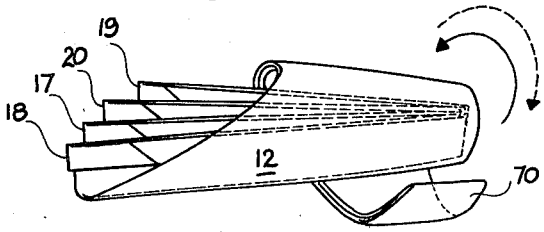

Turning now to FIG. 6, the completed waterbed liner unit 10 as manufactured is illustrated in FIG. 6*a*. To fold the completed liner for shipping, the two sides are pushed inwardly toward each other as shown by the arrows in FIG. 6*b* at the gaps 30 and 32 between the corresponding riser sections. The ends are then brought together as shown by the arrows in FIG. 6*c* trapping the midpoints 30 and 32 therebetween. The liner material hangs down in a truncated pyramid. The two corners 17 and 18 are then grasped and folded over to match the corners 20 and 19 as best seen in FIG. 60. The resulting truncated triangular gathering 70 of the waterbed liner 12 is then wrapped around the stacked group of risers 17–20 as seen in FIG. 6*e*. The completely folded waterbed liner unit 75 is shown in FIG. 6*f*. This completely folded liner may then be put in a plastic bag for ease of shipping.

Figure 6F:
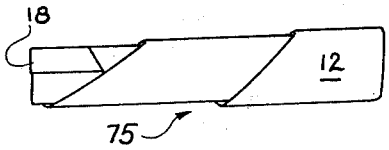

In the field the installer receives a folded and bagged seamless safety liner for the waterbed in the configuration of FIG. 6*f*. Reversing the steps 6*e–a*, the installer unrolls the floor portion of the liner as seen by the dashed arrows in FIGS. 6*e–*6*b*. This may be unrolled in the bottom of the actual waterbed frame, and the resulting instantly set up liner, which is free-standing, self-supporting and seamless, is seen in FIG. 6*a*. The waterbed mattress may thereafter be placed on the floor area 12 of the liner and filled with water to complete the installation.

As can be seen from the above description, we are able to eliminate the use of a high-frequency induction welding machine which is currently being used in the manufacture of the welded box corners and in the Delta Star-type welded, corner-fitted liner that has supporting strips welded into the liner. We are also able to eliminate the field labor of cutting cardboard, tacking, stapling or taping the support, and tucking the liner behind the supports or behind the "Tuckaliner"-type of liner retaining strips.

In the alternative to gluing the liner to the riser material, the fold tip 26 and the overlap strip 21 may be stapled to the outside of the riser or taped thereto. In still another embodiment, the fold 24 and overlap 21 may be inserted in vertical slots cut in the upper 2 or 3 inches of the liner spaced along the topmost edge 63.

It should be understood that various modifications within the scope of this invention can be made by one of ordinary skill in the art without departing from the spirit thereof. We therefore wish our invention to be defined by the scope of the claims as broadly as the prior art will permit and in view of this specification.

We claim:

1. A method of manufacture of a seamless waterbed safety liner assembly having a plurality of corners comprising the steps of:

(a) providing a continuous flat sheet of plastic having a floor area delineable therein, margins around said floor area for covering upstanding perimetral walls, and corners in said margins;

(b) providing a form with perimetral side walls and which substantially delineates said floor area;

(c) folding said margin corners of said sheet to provide seamless diagonal triangular hospital corner folds in said margins adjacent said corners;

(d) lapping excess margin plastic into said form;

(e) placing risers adjacent said corners, said risers having an interior face contacting said plastic and an exterior face, (f) reverse lapping said excess margin plastic over at least a portion of the exterior face of said risers; and (g) securing said excess margin plastic to the exterior face of said risers, thereby to form corners with said hospital corner fold tips lying on the exterior face of said rigid strips.

2. A method of manufacture as in claim 1 wherein at least some of the corners are folded sequentially.

3. A method of manufacture as in claim 1 wherein said rigid strips extend only partly along the perimetral edges of said sheet from said corners, and adjacent strips are separated from each other by a gap to permit folding.

4. A method of manufacture as in claim 1 wherein said securing step includes gluing said corner fold to said risers.

5. Method of manufacture as in claim 4 wherein said glue is applied to the exterior face of said risers before said risers are placed against said plastic-covered form.

* * * * *